United States Patent [19]

Welleman

[11] Patent Number: 4,955,940

[45] Date of Patent: Sep. 11, 1990

[54] APPARATUS FOR CARRYING LOADS, PARTICULARLY FOR OR AT A PALLET

[76] Inventor: Sven Welleman, Perstorp, S-540 30 Fagersanna (SE), Sweden

[21] Appl. No.: 358,361

[22] PCT Filed: Nov. 30, 1987

[86] PCT No.: PCT/SE87/00567

§ 371 Date: May 18, 1989

§ 102(e) Date: May 18, 1989

[87] PCT Pub. No.: WO88/04263

PCT Pub. Date: Jun. 16, 1988

[30] Foreign Application Priority Data

Dec. 3, 1986 [DE] Fed. Rep. of Germany ..... 8632080
Jun. 20, 1987 [DE] Fed. Rep. of Germany ..... 8707837

[51] Int. Cl.[5] ..... B65D 19/00

[52] U.S. Cl. ..... 108/56.1; 24/306; 248/916; 206/597

[58] Field of Search ..... 108/56.1, 56.3, 51.1; 248/916 X; 24/16 PB, 17 AP, 306; 206/597 X, 600

[56] References Cited

U.S. PATENT DOCUMENTS

| | | | |
|---|---|---|---|
| 3,383,738 | 5/1968 | Fox et al. | 297/248 X |
| 3,522,688 | 8/1970 | Kaliwoda et al. | 206/599 X |
| 3,650,224 | 3/1972 | Petix et al. | 108/56.1 X |
| 3,659,707 | 5/1972 | Nilsson et al. | 206/599 X |
| 3,841,648 | 10/1974 | Meyer | 24/306 |
| 4,036,364 | 7/1977 | Ambrose | 206/597 X |
| 4,128,253 | 12/1978 | Powers | 108/56.1 X |
| 4,253,570 | 3/1981 | O'Connor et al. | 206/597 X |
| 4,509,432 | 4/1985 | Win | 108/56.1 X |

*Primary Examiner*—Peter A. Aschenbrenner
*Attorney, Agent, or Firm*—Dann, Dorfman, Herrell and Skillman

[57] ABSTRACT

Apparatus for carrying loads, particularly a pallet comprising spacers (2,3). Two or more pallets are interconnected by means of pairs (1,5) of spacers provided in the adjacent areas of the said pallets. Such spacer pairs, one body of which belongs to the one pallet and the other one to the other pallet, are interconnected by severable means such as a bridge and/or a shrink film and/or tapes (12) allowing a so construed multiple pallet to be produced, transported, used and stored as a unit. In operation, one pair of spacers is provided to be severed and another one held together by the said interconnectors, so that the latter forms a hinge for positioning any of the separate pallets forming a multiple pallet.

9 Claims, 6 Drawing Sheets

FIG.1
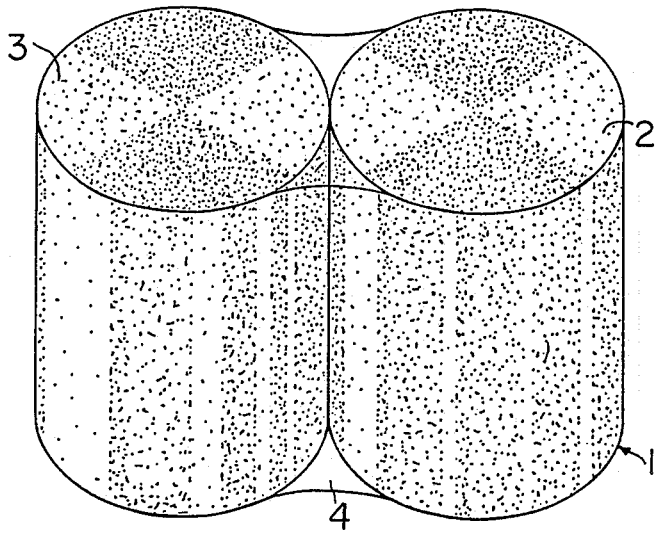
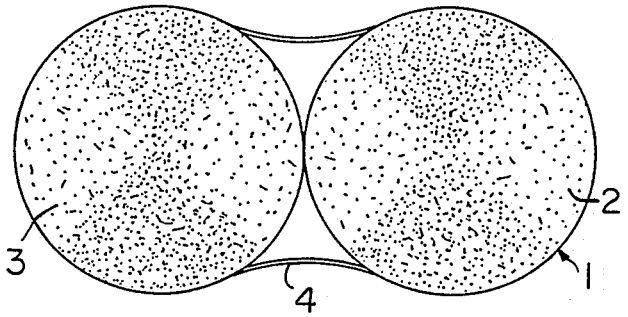
FIG.2
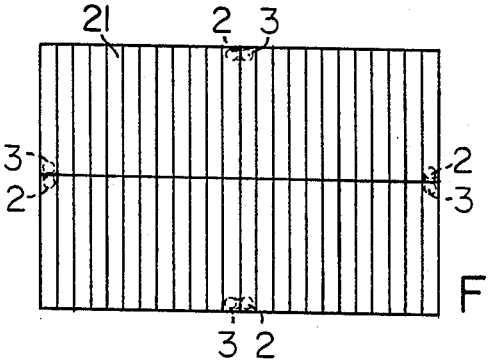
FIG.5

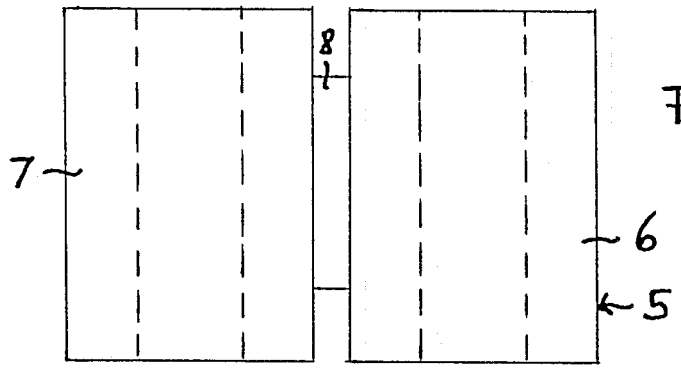
Fig. 3
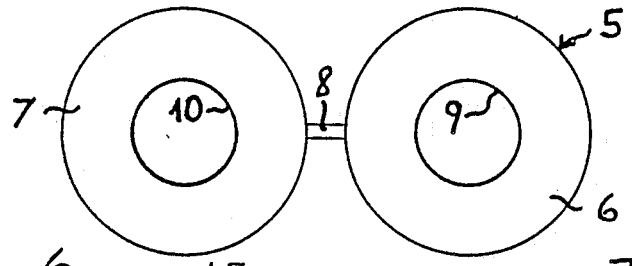
Fig. 4
Fig. 6
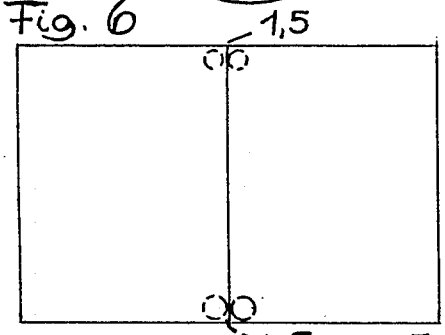
Fig. 7
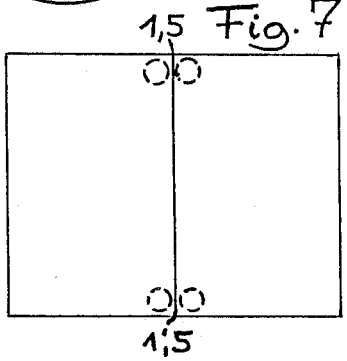
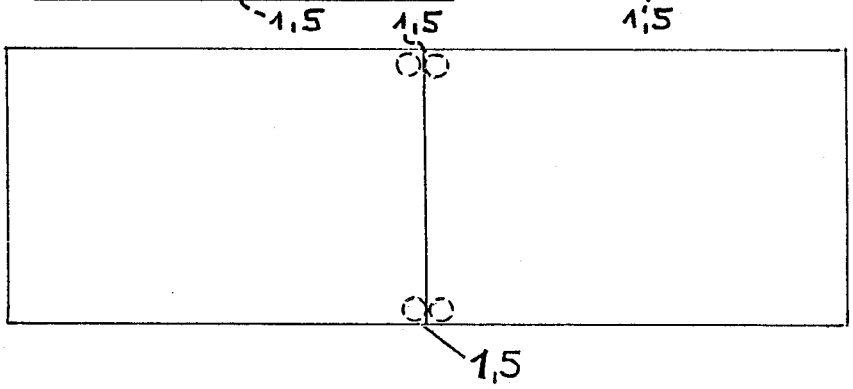
Fig. 8

FIG.12
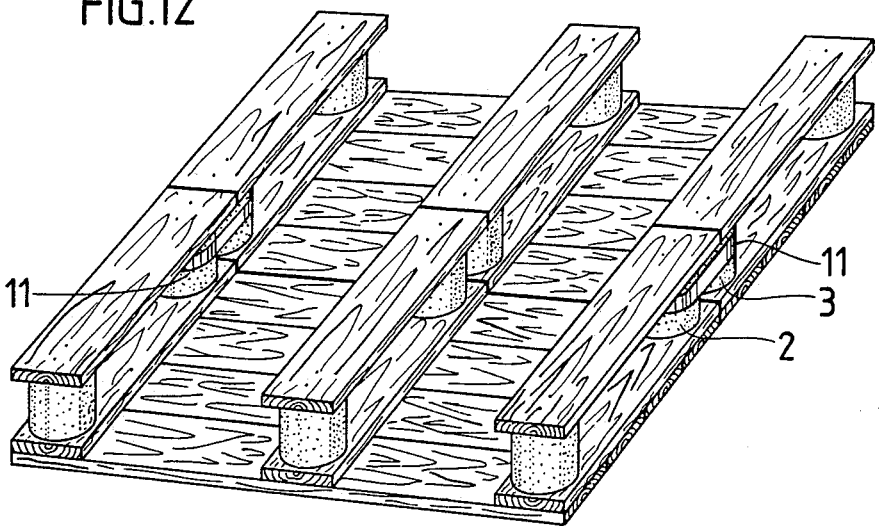
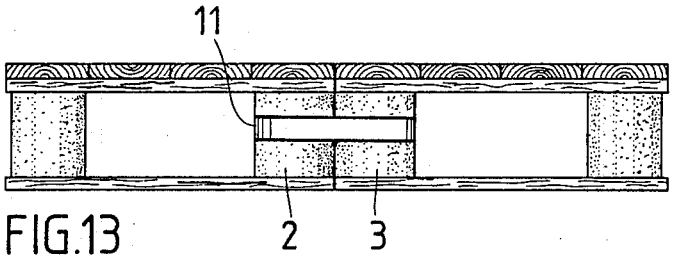
FIG.13
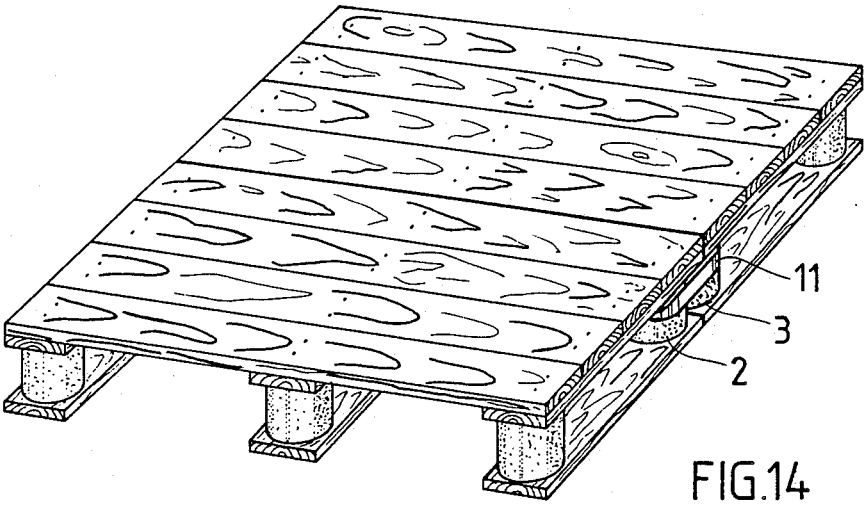
FIG.14

FIG.15
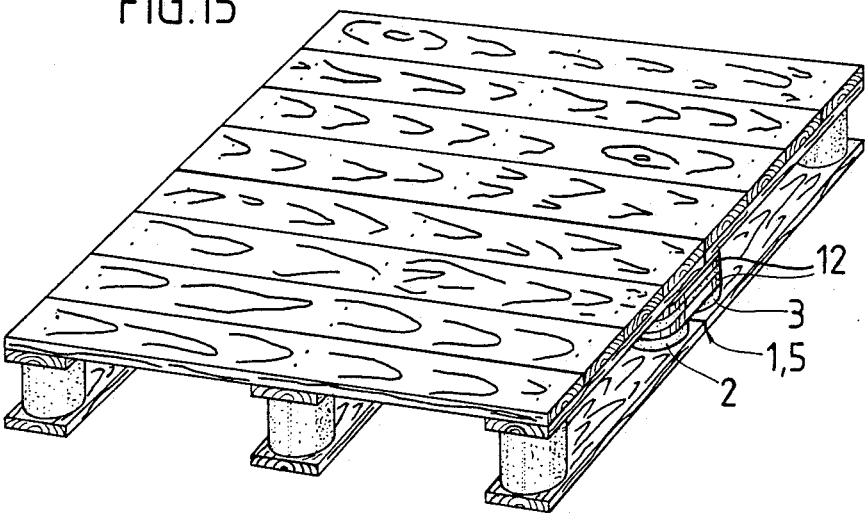
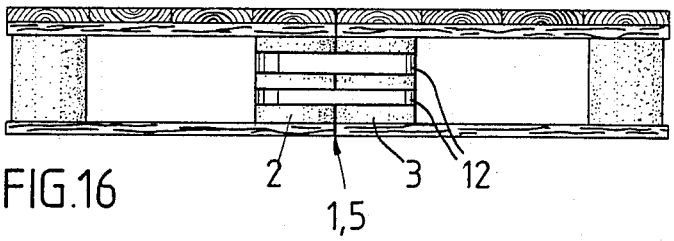
FIG.16
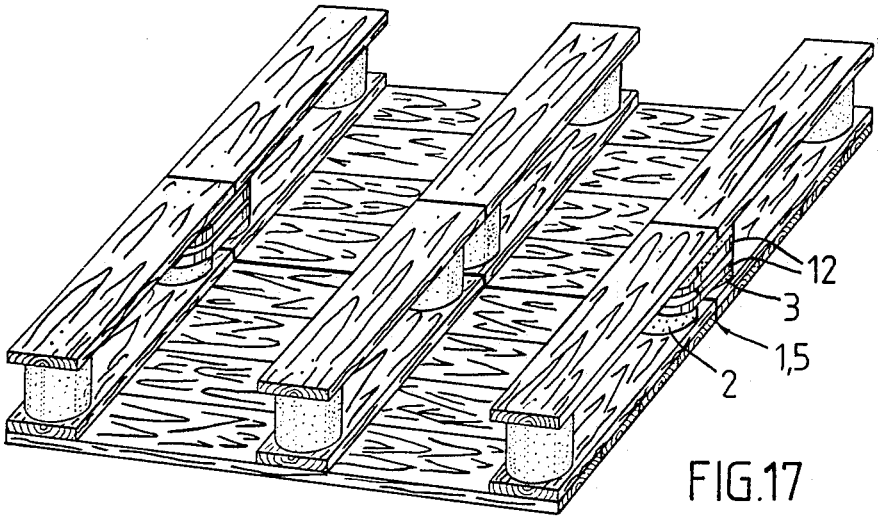
FIG.17

APPARATUS FOR CARRYING LOADS, PARTICULARLY FOR OR AT A PALLET

The invention relates to an apparatus for carrying loads, particularly to a pallet.

Pallets are frequently used throughout the world. Therefore, a detailed description of known techniques in general is not necessary.

A drawback with known pallets resides particularly in that handling of same, i.e. transport, packing and storing, often is very costly. It goes without saying, that e.g. relatively small pallets entail numerous operations, as they are to be produced, transported, packed and stored as such.

The objective of the present invention is to render production as well as transport, packing and storing of pallets in particular as economical as possible. It is furthermore an objective of the invention to improve and develop previously known pallets as well as parts of same in various technical respects.

These objectives are achieved according to the invention by an apparatus for carrying loads, particularly for or at a pallet, which apparatus is designed as revealed by the characterizing clause of claim 1.

Figure 9:
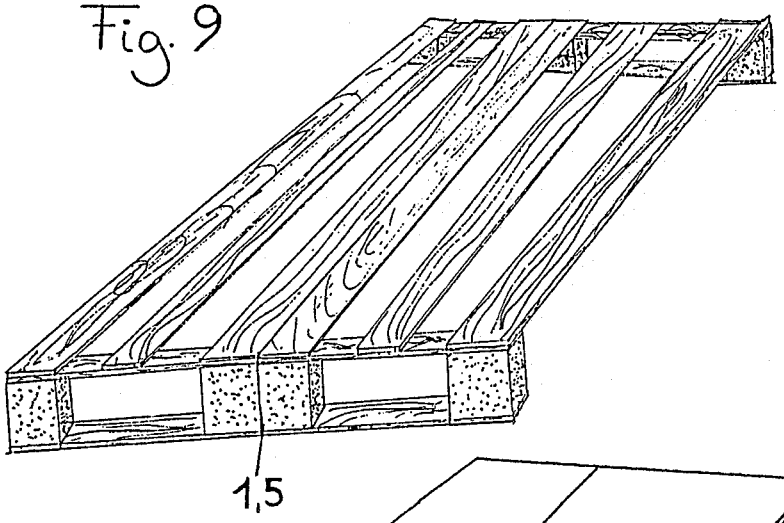
Figure 10:
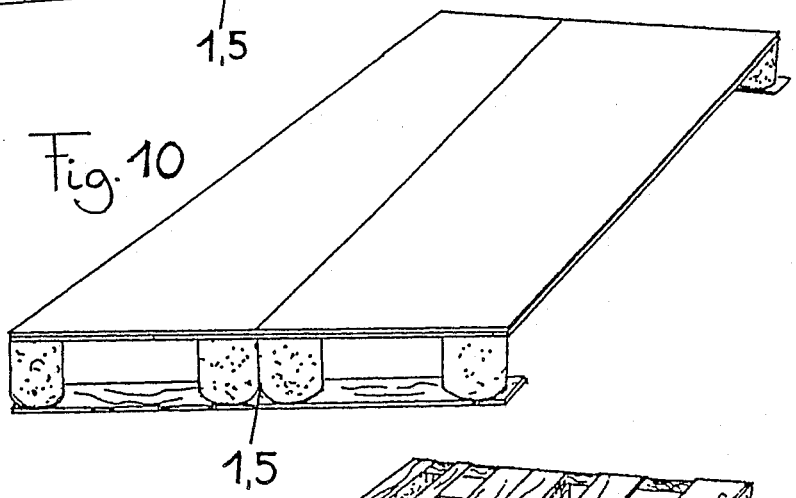
Figure 11:
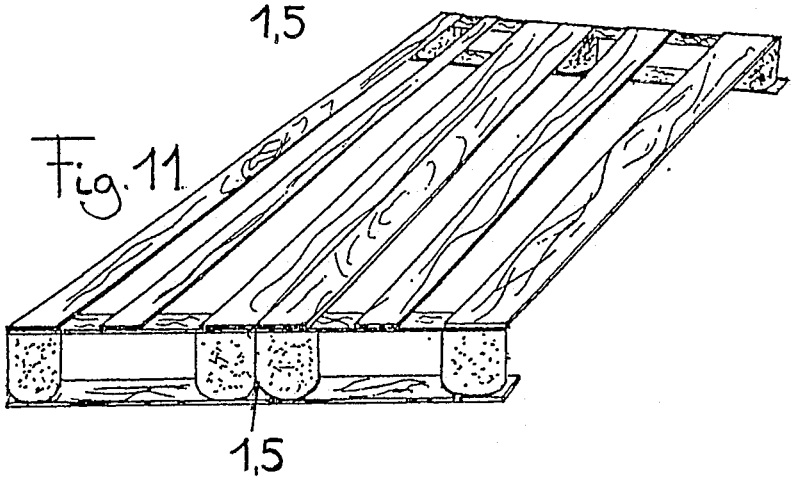
Figure 19:
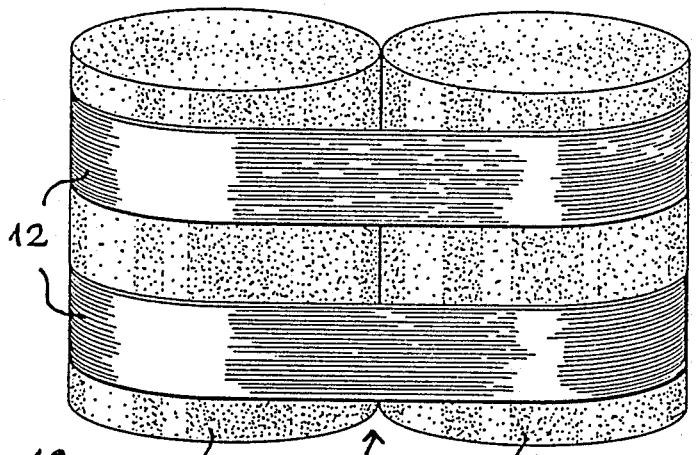
Figure 20:
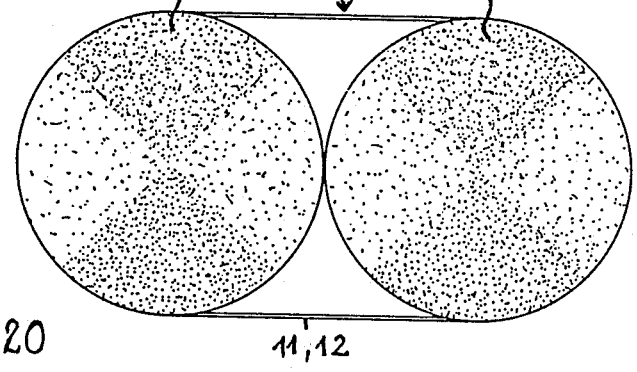
Figure 18:
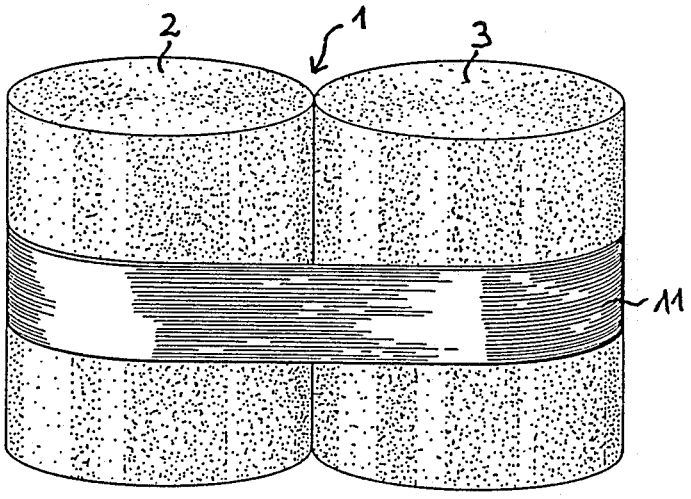

Further characteristics of and advantages with the invention appear from the following specification with reference to the accompanying drawings showing some embodiments, partly in diagrammatic views, which embodiments are to be regarded as non-limiting. In the drawings, FIG. 1 is a perspective view of an apparatus for carrying loads designed as a spacer, FIG. 2 is a plan view of the spacer according to FIG. 1, FIG. 3 is a side elevational view of a modified embodiment of a spacer according to the invention, FIG. 4 is a plan view of the spacer according to FIG. 3, FIGS. 5–8 are plan views of various diagrammatically shown pallet embodiments using spacers according to the invention, FIGS. 9–11 show various embodiments of pallets according to the invention in perspective views from above, FIGS. 12–14 show a perspective view from below, a side elevational view and a perspective view from above of a further embodiment according to the invention, FIGS. 15–17 show a perspective view from below, a side elevational view and a perspective view from above of a further embodiment according to the invention, FIG. 18 is a perspective view of a spacer according to FIGS. 12–14, FIG. 19 is a perspective view of a spacer according to FIGS. 15–17, and FIG. 20 is a plan view of the spacers according to FIGS. 18 and 19.

Each embodiment of the invention comprises a pallet having an upper side in the form of a load platform 21 and a lower side in the form of lower runners 22 extending parallel to opposite side edges of the upper load platform. The runners are spaced from the platform by spacers made according to the present invention. The platforms 21 are angular with corners which are designed to mate with complementary corners of a laterally-adjacent platform.

A spacer according to the invention as shown in FIGS. 1 and 2 comprises two cylindrical bodies 2, 3 with their axes in parallel and their peripheries in abutting relation to each other. The spacers are preferably made of wooden chips by presscasting.

According to another feature of the invention, such a pair of spacers is held together by a so called shrink film 4, which preferably is relatively thick, e.g. having a thickness of $10\mu$–$200\mu$.

According to the alternative 5 shown in FIGS. 3 and 4, there are also provided two cylindrical bodies 6, 7 which, however, are not abutting each other with their peripheries but are interconnected via a bridge 8. Furthermore, the bodies 6, 7 show preferably throughgoing central openings 9, 10. Even this embodiment can be produced by presscasting, preferably, however, it is made of a more durable material with e.g. plastic material or combinations of plastic material and/or fibers and chips respectively. Even pressed fibrous material of various kinds can be considered.

According to the invention, each pallet will not be produced separately. Instead, at least two, possibly even three, four or more pallets are produced simultaneously with the pallet sides abutting each other showing pairs of spacers, the interconnectors 4, 8 of which are bridging the pallets. These interconnectors 4, 8 are so strong and durable, that two or more pallets held together in such way consecutively can be transported, packed and stored coherently. Even loading the pallets can be carried out, while two or more pallets are still united in this way. Only at a time, which individually can be chosen, the pallets can be severed from each other, e.g. by cutting through the interconnectors 4, 8 by a knife, a saw or the like.

Normally, pallets interconnected in such way are separate from each other except for the spacers and the said interconnectors. According to a further feature of the invention, it is possible that adjacent pallets entirely or partly are produced as a unit, e.g. with a throughgoing upper and/or lower side, which then is e.g. cut through, in case a consecutive separation is desired.

The present invention is not limited to the examples as described hereinbefore and shown in the accompanying drawings but may be modified and completed within the framework of the inventive idea in any way. Naturally, the provision of spacer pairs may in general be regarded as a pallet reinforcement, as the center areas in particular of such a multiple pallet will be reinforced substantially.

According to FIGS. 12–20, there are provided spacer pairs surrounded and held together by tapes 11 or pairs of tapes 12 of preferably plastic material. Naturally, it is within the framework of the inventive idea to provide interconnections in the form of shrink film and/or bridges and/or tapes simutaneously in any combination.

It should be noted, that the pairs of spacers according to the invention are able to serve as a hinge, namely when the tapes interconnectors of one pair have been severed, meanwhile the other pair is still held together by surrounding tapes interconnectors. In this way, e.g. a truck is able to grasp one pallet and put same in an exact predetermined position. Through the so-positioned pallet, the other pallet may be positioned as well in any desired position per se or in relation to the said grasped pallet.

I claim:

1. Apparatus for carrying loads, comprising a pair of laterally-adjacent load supports having coplanar upper platforms, lower runners along opposite side edges of said platforms to couple said laterally-adjacent load supports together with their platforms and runners coplanar and spacers having bodies between said platforms and said runners, at least one of said bodies in each support confronting one of said bodies in the laterally-adjacent support and being held together by severable holding means.

2. Apparatus for carrying loads according to claim 1, characterized in that the holding means is a shrink film (4) surrounding the bodies preferably on all sides.

3. Apparatus for carrying loads surrounding to claim 1, characterized in that the holding means is a bridge (8) provided in the transitional area between the spacers.

4. Apparatus for carrying loads according to claim 1, characterized in that tapes of plastic material surround the spacers to serve as said holding means.

5. Apparatus for carrying loads according to claim 1, characterized in that the spacers are cylindrical bodies with throughgoing central openings.

6. Apparatus for carrying loads according to claim 1, characterized in that the spacers are at least partly provided as presscasted bodies comprising material selected from a group consisting of fibers, chips and plastic material.

7. Apparatus for carrying loads according to claim 1, wherein said platforms have corners which mate, characterized in that said held-together spacers comprise a first pair positioned at one of said mating corners and are provided as corner load-carriers and spacer elements.

8. Apparatus for carrying loads according to claim 7, including a second pair of spacers mounted on said pair of load supports, said second pair of spacers being held together by severable holding means, the first of said pairs serving as a hinge for positioning the pallets held together in relation to each other when the second pair has its holding means severed.

9. Apparatus according to claim 8, wherein said severable holding means comprise plastic tape surrounding the bodies of each of said first and second pairs of spacers.

* * * * *